US010714907B2

(12) United States Patent
Mixell et al.

(10) Patent No.: US 10,714,907 B2
(45) Date of Patent: Jul. 14, 2020

(54) CORONA IGNITER FIRING END ELECTRODE TIP WITH DUAL METAL RIVETS AND METHOD OF MANUFACTURE

(71) Applicant: Federal-Mogul LLC, Southfield, MI (US)

(72) Inventors: Kristapher I. Mixell, Plymouth, MI (US); James D. Lykowski, Temperance, MI (US); Yusuf Esmail Neemuchwala, Livonia, MI (US)

(73) Assignee: Tenneco Inc., Lake Forest, IL (US)

( * ) Notice: Subject to any disclaimer, the term of this patent is extended or adjusted under 35 U.S.C. 154(b) by 0 days.

(21) Appl. No.: 16/113,177

(22) Filed: Aug. 27, 2018

(65) Prior Publication Data

US 2019/0067916 A1 Feb. 28, 2019

Related U.S. Application Data

(60) Provisional application No. 62/550,970, filed on Aug. 28, 2017.

(51) Int. Cl.

| | |
|---|---|
| ***H01T 19/04*** | (2006.01) |
| ***F02P 23/04*** | (2006.01) |
| ***H01T 13/50*** | (2006.01) |
| ***H01T 13/39*** | (2006.01) |
| *F02P 3/01* | (2006.01) |

(52) U.S. Cl.

CPC ..... *H01T 19/04* (2013.01); *F02P 23/04* (2013.01); *F02P 23/045* (2013.01); *H01T 13/39* (2013.01); *H01T 13/50* (2013.01); *F02P 3/01* (2013.01)

(58) Field of Classification Search

CPC ..... H01T 19/04; H01T 13/50; H01T 13/39; F02P 23/04; F02P 3/01; F02P 23/045

See application file for complete search history.

(56) References Cited

U.S. PATENT DOCUMENTS

| | | | | |
|---|---|---|---|---|
| 3,868,530 | A * | 2/1975 | Eaton | H01T 13/39 313/141 |
| 5,456,624 | A * | 10/1995 | Moore | H01T 13/39 219/93 |
| 8,776,751 | B2 | 7/2014 | Hampton et al. | |
| 9,325,157 | B2 | 4/2016 | Kawada | |
| 9,373,941 | B2 | 6/2016 | Achstätter et al. | |
| 9,464,618 | B2 | 10/2016 | Stifel et al. | |
| 9,593,662 | B2 | 3/2017 | Stifel et al. | |

(Continued)

*Primary Examiner* — Kevin Quarterman

(74) *Attorney, Agent, or Firm* — Robert L. Stearns; Dickinson Wright, PLLC

(57) ABSTRACT

A firing tip for a corona igniter is provided. The firing tip includes a base formed of metal, such as nickel, and rivets formed of precious metal, such as iridium. The base includes indentations, and the rivets are disposed in the indentations of the base. The rivet has a melting point and/or wear resistance greater than the base. Typically, the indentations of the base include a concave surface and the rivets have a cylindrical shape matching the shape of the indentations. The rivets can be sharpened to a point. The rivets can include a first piece formed of precious metal and a second piece formed of nickel or nickel alloy, wherein an end of the first piece is welded to an end of the second piece, and the second piece is welded to the base. Alternatively, the rivets can be formed entirely of the precious metal.

24 Claims, 4 Drawing Sheets

(56) References Cited

U.S. PATENT DOCUMENTS

| | | | | |
|---|---|---|---|---|
| 2007/0069618 | A1* | 3/2007 | Havard | H01T 13/20<br>313/141 |
| 2007/0236124 | A1* | 10/2007 | Lykowski | H01T 13/20<br>313/141 |
| 2008/0018217 | A1* | 1/2008 | Boehler | H01T 13/39<br>313/141 |
| 2009/0127996 | A1* | 5/2009 | Passman | H01T 13/39<br>313/136 |
| 2013/0320835 | A1* | 12/2013 | Kowalski | H01T 13/39<br>313/141 |
| 2014/0103792 | A1* | 4/2014 | Ma | H01T 13/39<br>313/141 |
| 2014/0116370 | A1* | 5/2014 | Stifel | F02P 23/04<br>123/143 B |
| 2014/0261273 | A1* | 9/2014 | Achtstatter | H01T 13/39<br>123/169 R |
| 2015/0102721 | A1* | 4/2015 | Walker, Jr. | H01T 13/20<br>313/141 |
| 2017/0358906 | A1* | 12/2017 | Kuhnert | H01T 13/32 |

* cited by examiner

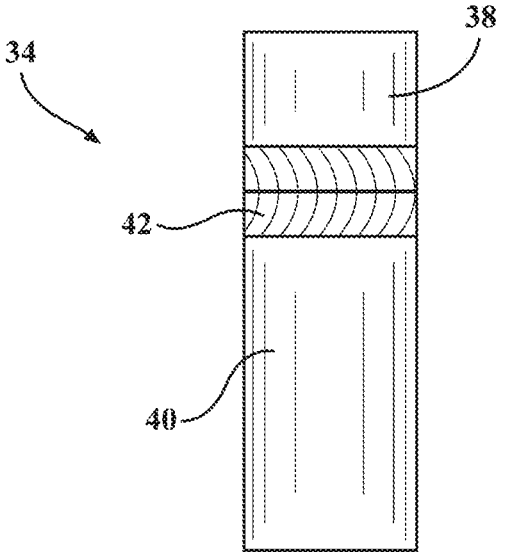
FIG. 4A
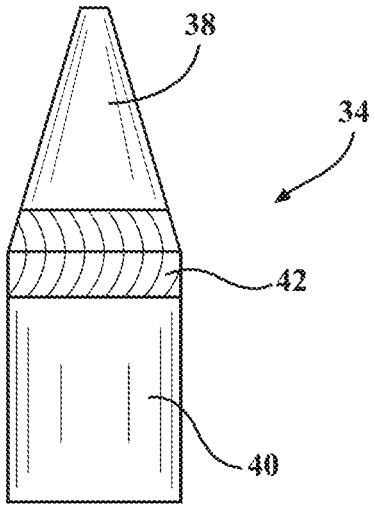
FIG. 4B
FIG. 5A
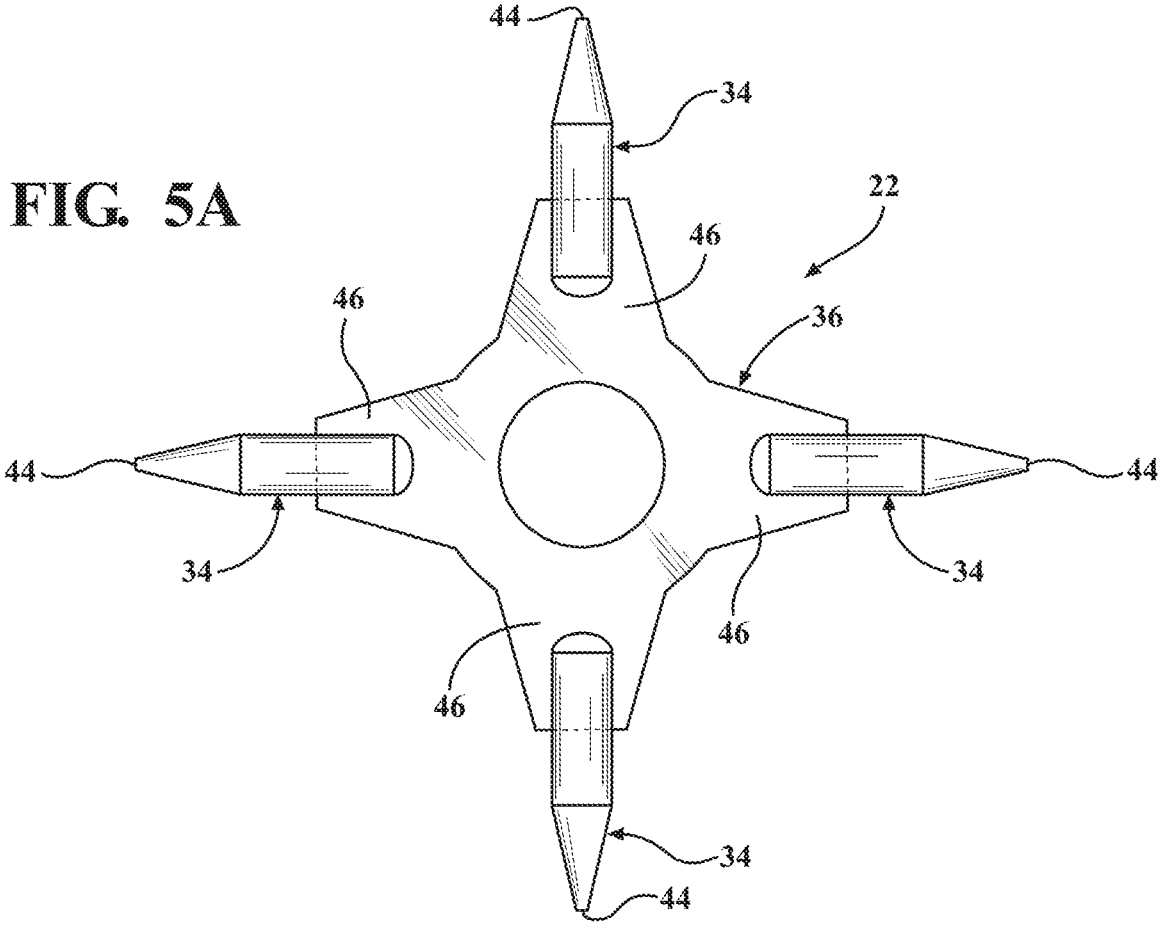

CORONA IGNITER FIRING END ELECTRODE TIP WITH DUAL METAL RIVETS AND METHOD OF MANUFACTURE

CROSS-REFERENCE TO RELATED APPLICATIONS

This U.S. utility application claims priority to U.S. provisional patent application No. 62/550,970, filed Aug. 28, 2017, the entire contents of which is incorporated herein by reference in its entirety.

BACKGROUND

1. Field of the Invention

This invention relates generally to corona ignition assemblies, and methods of manufacturing the corona ignition assemblies.

2. Related Art

Corona discharge ignition systems provide an alternating voltage and current, reversing high and low potential electrodes in rapid succession which enhances the formation of corona discharge and minimizes the opportunity for arc formation. The system typically includes a transformer receiving energy from a power supply in the form of a direct current, amplifying the voltage, and reducing the current prior to directing the energy in the form of an alternating current toward a central electrode of the corona igniter. The central electrode is charged to a high radio frequency voltage potential and creates a strong radio frequency electric field in a combustion chamber. The electric field causes a portion of a mixture of fuel and air in the combustion chamber to ionize and begin dielectric breakdown, facilitating combustion of the fuel-air mixture, which is referred to as an ignition event. The electric field is preferably controlled so that the fuel-air mixture maintains dielectric properties and corona discharge occurs, also referred to as non-thermal plasma. The ionized portion of the fuel-air mixture forms a flame front which then becomes self-sustaining and combusts the remaining portion of the fuel-air mixture. Preferably, the electric field is controlled so that the fuel-air mixture does not lose all dielectric properties, which would create thermal plasma and an electric arc between the electrode and grounded cylinder walls, piston, metal shell, or other portion of the igniter. An example of a corona discharge ignition system is disclosed in U.S. Pat. No. 6,883,507 to Freen.

The igniter of the corona ignition system can include a firing tip at the firing end of the central electrode. The firing tip includes a plurality of edges which generate the corona discharge. Due to electrical and thermo-chemical action at the corona generating edges, the edges of the firing tip are prone to corrosion and erosion. The distal ends of the electrode firing tip are most vulnerable to the corrosion and erosion due to thermal cycling, location in the chamber, and being the primary corona formation feature. Certain metals are more susceptible to this type of wear than others. Since corona formation is dependent on electrical fields produced by sharp geometries, the wearing or rounding of the edges and distal ends of the firing tip results in degradation of the igniter performance over time. This puts more stress on the electrical system to keep up the performance levels. Rounding and wearing of the firing tips also negatively impacts corona formation at the edges and distal ends, and certain combustion strategies become difficult to achieve.

SUMMARY

One aspect of the invention provides a firing tip for a corona igniter. The firing tip comprises a base formed of metal and at least one rivet. The base includes at least one indentation, and each rivet is disposed in one of the indentations of the base. The at least one rivet includes at least one precious metal and has a melting point and/or wear resistance greater than the base.

Another aspect of the invention provides a corona igniter. The corona igniter includes a central electrode formed of an electrically conductive material and including a firing end. A firing tip is disposed on the firing end of the central electrode. The firing tip comprises a base formed of metal and at least one rivet. The base includes at least one indentation, and each rivet is disposed in one of the indentations of the base. The at least one rivet includes at least one precious metal and has a melting point and/or wear resistance greater than the base.

Another aspect of the invention provides a method of manufacturing a firing tip. The method comprises the steps of: providing a base formed of metal and including at least one indentation, and disposing at least one rivet in one of the indentations of the base. The at least one rivet includes at least one precious metal and has a melting point and/or wear resistance greater than the base.

Another aspect of the invention provides a method of manufacturing a corona igniter. The method comprises the steps of providing a central electrode formed of an electrically conductive material and including a firing end; and disposing a firing tip on the firing end of the central electrode. The firing tip includes a base formed of metal and includes at least one indentation. The firing tip also includes at least one rivet. Each rivet is disposed in one of the indentations of the base. The at least one rivet is formed of at least one precious metal and has a melting point and/or wear resistance greater than the base.

BRIEF DESCRIPTION OF THE DRAWINGS

Other advantages of the present invention will be readily appreciated, as the same becomes better understood by reference to the following detailed description when considered in connection with the accompanying drawings wherein:

FIG. 4 includes enlarged views of rivets of the firing tips of FIGS. 2 and 3;

FIGS. 5A-5C include a bottom and two side views of the firing tip according to another example embodiment.

DETAILED DESCRIPTION OF EXEMPLARY EMBODIMENTS

Figure 1:
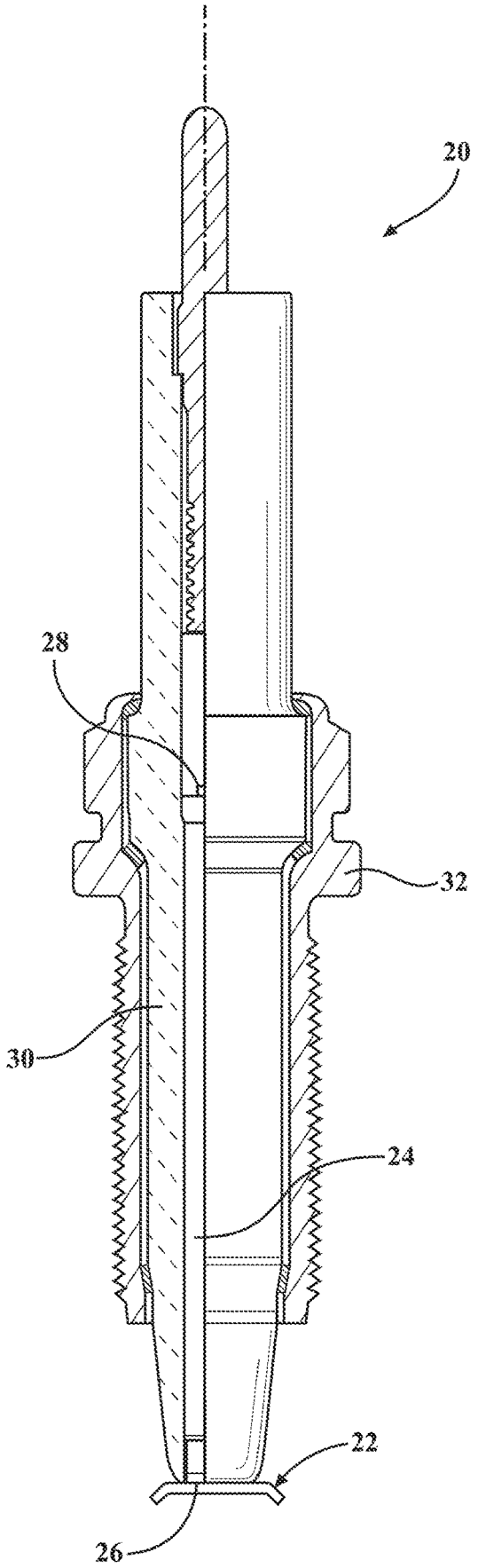
FIG. 1 is a cross-sectional view of a corona igniter which can include a firing tip manufactured according to embodiments of the present invention.

The invention provides a corona igniter 20 including an improved firing tip 22 which can be used in an internal combustion engine. An example of the corona igniter 20 is shown in FIG. 1, and examples of the firing tips 22 are shown in FIGS. 2-5. The invention also provides the firing tip 22 for the corona igniter 20, a method of manufacturing the corona igniter 20, and a method of manufacturing the firing tip 22.

As shown in FIG. 1, the firing tip 22 is typically attached to a central electrode 24 at a firing end 26. The central electrode 24 is formed of an electrically conductive material for receiving a high radio frequency voltage and emitting a radio frequency electric field to ionize a fuel-air mixture and provide a corona discharge. In the example embodiments, the central electrode 24 extends from an electrode terminal end 28 receiving the high radio frequency voltage to the firing end 26. An insulator 30 formed of an electrically insulating material is disposed around the central electrode 24. A shell 32 formed of an electrically conductive metal material is disposed around the insulator 30.

Figure 2:
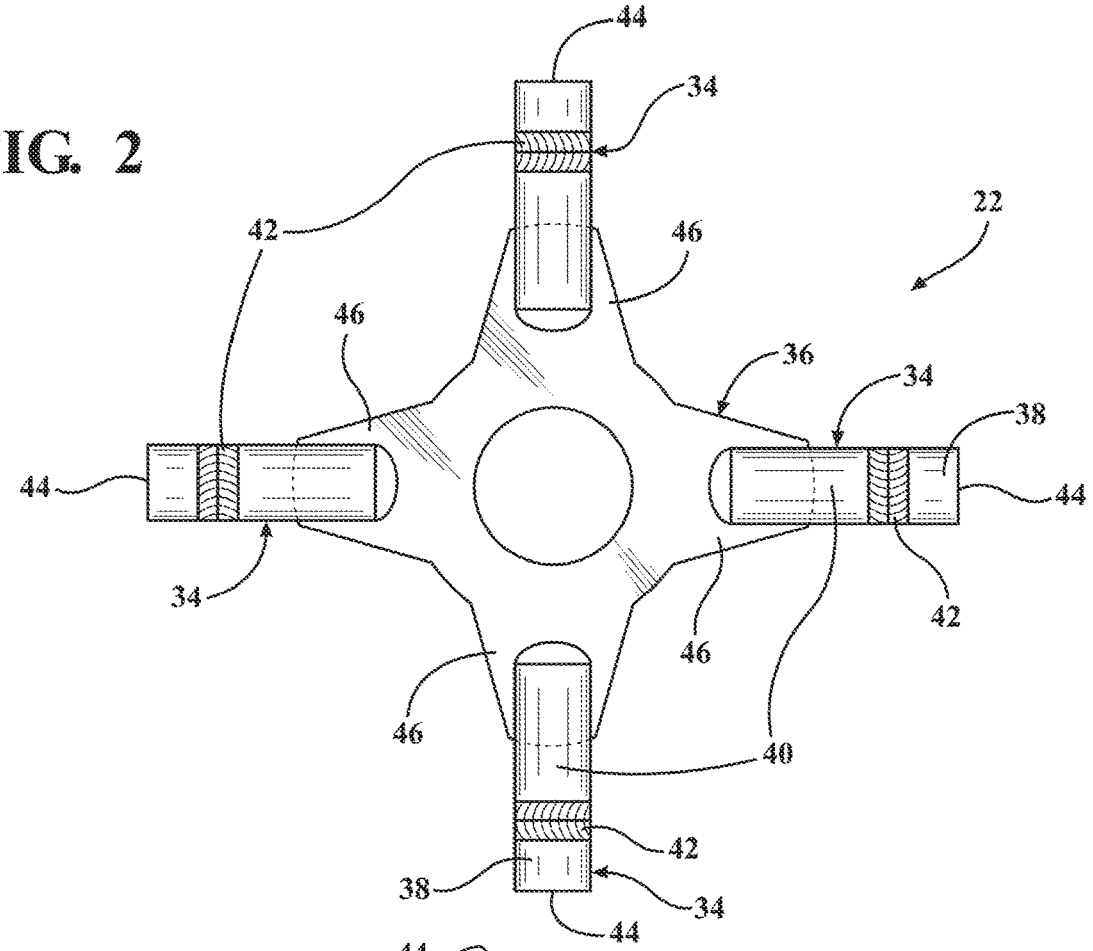
FIG. 2 is a bottom view of the firing tip according to a first example embodiment.
Figure 3:
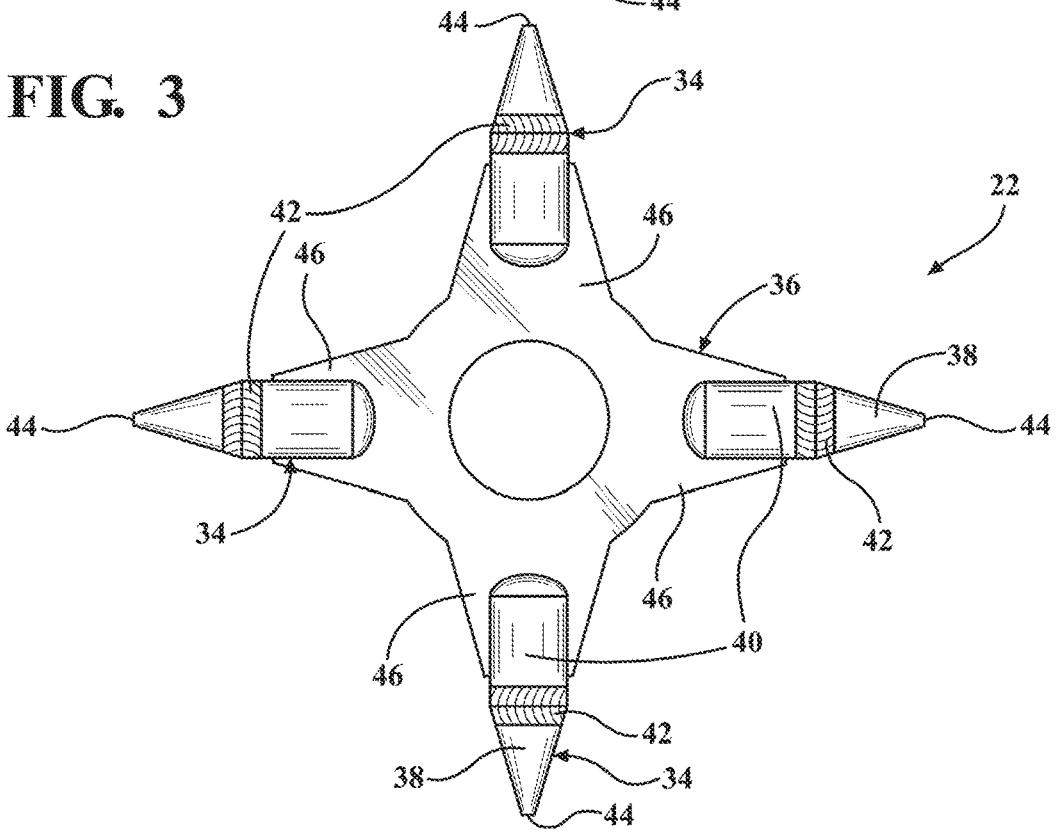
FIG. 3 is a bottom view of the firing tip according to a second example embodiment.

In the embodiments of FIGS. 2-4, the firing tips 22 include at least one multi-piece rivet 34 attached to a base 36. Typically, the firing tip 22 includes multiple rivets 34, for example four rivets 34 spaced equally from one another and located symmetrically around a longitudinal axis of the firing tip 22. However, the rivets 34 could be asymmetric about the longitudinal axis. Each rivet 34 includes at least one first piece 38 connected to a second piece 40. The first piece 38 is formed of a precious metal and/or precious metal alloy. Certain precious metals and alloys are known to wear less than other metals. The second piece 40 is typically formed of nickel or a nickel alloy, but may be formed of another metal, such as another metal having a melting point and/or wear resistance lower than the precious metal first piece 38. More specifically, the nickel or nickel alloy typically used to form the second piece 40 or weld end of the rivet 34 has wear properties not similar, and typically significantly worse, than the first piece 38 or discharge end made of iridium alloys or other precious metals.

The base 36 of the firing tip 22 is also typically formed of nickel or a nickel alloy, but may be formed of another metal, such as another metal having a melting point and/or wear resistance lower than the precious metal first piece 38. The precious metal first piece 38 or discharge end of the rivet 34 is generally smaller in size compared to the second piece 40 or weld end. The base 36 to which the rivets 34 are attached may be formed, stamped, or laser/water jet cut, but typically is not sintered.

By making use of the different types of metals mentioned above in strategic locations, the overall wear on the firing tip 22 can be reduced. Typically, precious metals are not easily attached to nickel or nickel alloys, such as a base of an electrode tip, because the high melting points result in low weldability. The precious metal first piece 38 of the rivets 34, however, can be attached to the second piece 40 with a laser welded butt joint 42. The second pieces 40 of the rivets 34, which are typically a nickel alloy, are then attached to the base 36, which is also typically a nickel alloy. Welding the nickel alloy second piece 40 to the base 36 has advantages of being cost effective and easily weldable. The first piece 38, such as an iridium alloy end, has the advantages of better wear properties and a better heat transfer coefficient than the second piece 40. Since a higher percentage of the overall volume of the rivet 34 is typically a nickel alloy, the cost of the firing tip 22 is reduced significantly, compared to other firing tip 22 designs. Furthermore, the first piece 38 of the rivet 34 may be sharpened to a point or cut obliquely to enhance corona formation. The ends of each rivet 24 could also be made sharp in three dimensions, or three-dimensionally sharp. The points will hold this shape longer due better wear characteristics resulting in lowering input voltage to operate the system as well as achieve corona ignition at combustion points that are usually difficult to ignite with rounded firing ends. Additionally, attaching the sharp tips 22 to the base 36 is not trivial and typically involves micromachining and complicated manufacturing processes, which in turn increases the cost of the firing end. However, these costs and complications are reduced due to the cost effective methods discussed herein.

A first example embodiment is shown in FIG. 2, and a second example embodiment is shown in FIG. 3. According to these embodiments, the firing tip 22 includes four rivets 34 attached to the base 36. The rivets 34 are made of two metals. The first piece 38, also referred to as the precious metal portion or discharge end, of the rivet 34 is generally smaller in size compared to the second piece 40, also referred to as the base metal or weld end. In this case, the first piece 38 is formed of a precious metal, specifically Iridium 21, and the second piece 40 is formed of a nickel alloy, specifically nickel chrome.

Each rivet 34 of the first and second example embodiments is assembled by providing a first elongated material which is used to form the first piece 38, and a second elongated material which is used to form the second piece 40. The elongated materials can have a cylindrical shape, for example the shape of a wire or a rod, wherein the length of the cylinder is longer than the diameter. The two elongated materials are then joined and severed to create one of the rivets 34 of the firing tip 22. In this example embodiment, the first piece 38 and the second piece 40, which are formed of two distinct metals, are attached by means of a weld, specifically a laser butt joint 42. An end of the first piece 38 can be welded to an end of the second piece 40, as shown in FIGS. 2-4. However, other methods can be used to join the first piece 38 to the second piece 40. In the first example embodiment of FIG. 2, distal ends 44 of the rivets 34, which are provided by the first pieces 38, remain an unsharpened cylindrical shape. In the second example embodiment of FIG. 3, the distal end of the precious metal first piece 38 is sharpened to a point edge with a cone angle between 20 to 60 degrees. The ends can be three-dimensionally sharp. The sharp distal end provides uniform wear while maintaining the sharpness. Enlarged views of the rivets 34 of FIGS. 2 and 3 are shown in FIG. 4.

In the first and second example embodiments, the base of the firing tip 22 is usually made of a low cost, high weldability, medium wear property metal or metal alloy. For example, the base typically has lower wear resistance than the precious metal first pieces 38. As shown in FIGS. 2 and 3, the base is designed to have multiple rivet accepting extensions 46. These extensions 46 have an indentation 48 where the rivet 34 is placed and attached. The rivets 34 have an outer surface which is typically convex, and the indentations 48 present a surface which is concave and matches the shape of the rivets 34. The second piece 40 of the rivet 34 is typically attached to the base by welding, but can be attached by another method. The extensions 46 may be symmetric or asymmetric around the longitudinal axis of the firing tip 22. The firing tip 22 including the base and rivets 34 is then attached to the firing end 26 of central electrode 24 by welding or another method. However, the rivets 34 are not plugged into holes in an ignition head. The base and welded rivets 34 are together crimped and bent in the same direction so that the rivet accepting extensions 46 and rivets 34 extend downward, typically at an angle between 15 to 45 degrees.

Figure 5B:
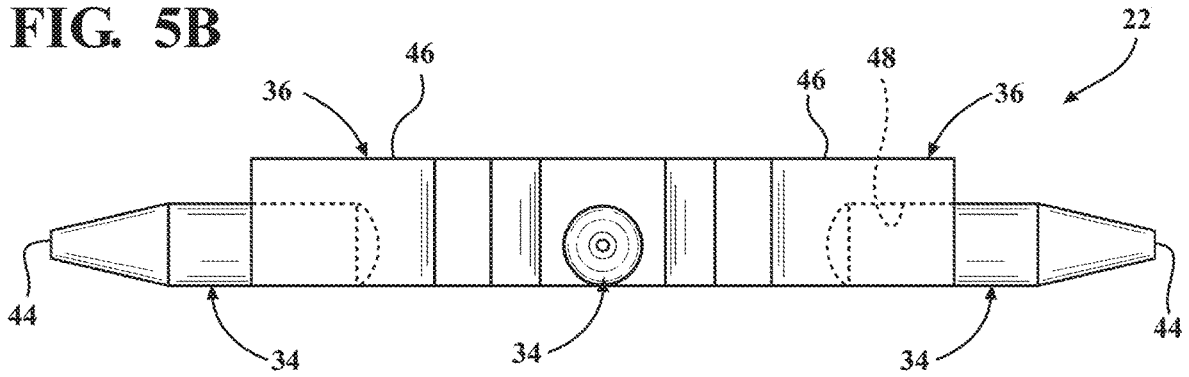
Figure 5C:
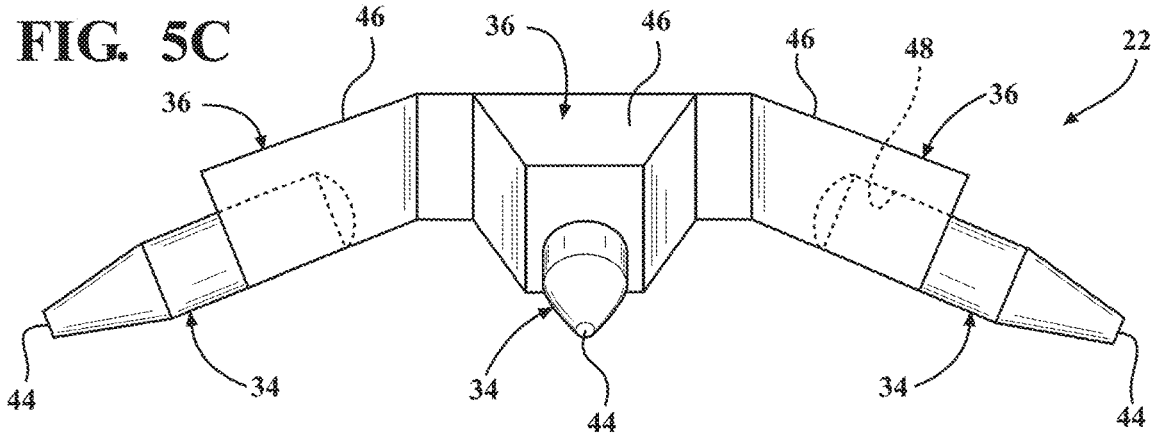

Yet another possible design is shown in FIGS. 5A-5C. In this case, the rivets 34 are a single piece formed entirely of precious metal, such as platinum, a platinum alloy, iridium, or an iridium alloy. The firing tip 22 includes four of the rivets 34, and the rivets 34 are attached to the base. The base is stamped from a sheet of material having a melting point and/or wear resistance lower than the precious metal, such as nickel or a nickel alloy, and includes four of the rivet accepting extensions 46 equally spaced from one another. Each rivet accepting extension 46 includes an indentation 48 for retaining one of the rivets 34, and each rivet 34 is welded to one of the indentations 48. The rivets 34 have an outer surface which is typically convex, and the indentations 48 present a surface which is concave and matches the shape of the rivets 34. The base and welded rivets 34 are together crimped and bent so that the rivet accepting extensions 46 and rivets 34 extend downward, typically at an angle between 15 to 45 degrees. The ends of these rivets 34 can also be three-dimensionally sharp.

As discussed above, the embodiments described herein provide numerous advantages. Several advantages are achieved by the use of multiple two-piece rivets 34 attached to the base 36 for producing the firing tip 22 at the firing end 26 of the central electrode 24. A single rivet 34 can consist of a nickel alloy wire laser butt welded to an iridium alloy wire to form the first and second pieces 40. The nickel second piece 40 provides high weldability to the base 36 and the iridium first piece 38 provides high wear resistance to harsh combustion environments resulting in longer service life. Furthermore, the iridium first piece 38 of the rivet 34 can be manufactured to a desired sharpness which helps in enhancing performance and efficiency.

Figure 6:
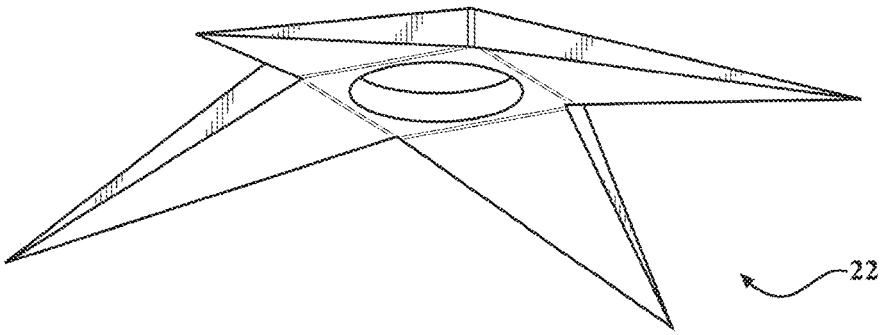
FIG. 6 illustrate a firing tip according to another example embodiment which is formed entirely of precious metal.

According to another embodiment, the firing tip 22 is formed entirely of the precious metal, such as platinum, a platinum alloy, iridium, or an iridium alloy. The firing tip 22 includes at least one prong 52 with a sharp end. An example of this firing tip 22 formed entirely of the precious metal is shown in FIG. 6. According to this embodiment, the firing tip 22 includes four of the prongs 52, and the end of each prong 52 is sharpened to a point. Each prong 52 can be three-dimensionally sharp.

Obviously, many modifications and variations of the present invention are possible in light of the above teachings and may be practiced otherwise than as specifically described while within the scope of the claims. It is contemplated that all features described and of all embodiments can be combined with each other, so long as such combinations would not contradict one another.

The invention claimed is:

1. A firing tip for a corona igniter, comprising:

a base formed of metal and including a plurality of indentations, a plurality of rivets, each rivet disposed in one of said indentations of said base, each rivet including at least one precious metal and having a melting point and/or wear resistance greater than said base, said rivets are spaced from one another about a longitudinal axis of said firing tip, and said rivets project radially away from said longitudinal axis.

2. A firing tip according to claim 1, wherein said base is formed of nickel or a nickel alloy, and said at least one precious metal includes iridium or platinum.

3. A firing tip according to claim 1, wherein said rivets are spaced equally from one another and located symmetrically around said longitudinal axis of said firing tip.

4. A firing tip according to claim 1, wherein each rivet is formed entirely of said at least one precious metal.

5. A firing tip according to claim 1, wherein said base and said rivets are bent in the same direction and are disposed at the same angle relative to said longitudinal axis.

6. A firing tip according to claim 1, wherein each rivet has an outer surface which is convex, and each indentation has a surface which is concave and matches the shape of said rivet disposed therein.

7. A firing tip according to claim 1, wherein said base is formed of nickel or a nickel alloy, said at least one precious metal includes an iridium alloy or platinum alloy, four of said rivets and four of said indentations are spaced equally from one another and located symmetrically around a longitudinal axis of said firing tip, each rivet is sharpened to a point, said base and said rivets are bent in the same direction and are disposed at the same angle relative to said longitudinal axis, said rivets have an outer surface which is convex, and said indentations present a surface which is concave and matches the shape of said rivets.

8. A firing tip according to claim 1, wherein said base includes extensions, each extension projects radially away from said longitudinal axis and includes one of said indentations containing one of said rivets.

9. A firing tip according to claim 8, wherein said extensions and said rivets are disposed at the same angle relative to said longitudinal axis.

10. A firing tip according to claim 1, wherein each rivet includes a first piece connected to a second piece, said first piece is formed of said at least one precious metal, said second piece is formed of nickel or a nickel alloy, and said base is formed of nickel or a nickel alloy.

11. A firing tip for a corona igniter, comprising:

a base formed of metal and including at least one indentation, at least one rivet, each rivet disposed in one of said indentations of said base, said at least one rivet including at least one precious metal and having a melting point and/or wear resistance greater than said base, wherein each of said at least one rivet includes a first piece connected to a second piece, said first piece is formed of said at least one precious metal, said second piece is formed of nickel or a nickel alloy, and said base is formed of nickel or a nickel alloy.

12. A firing tip according to claim 11, wherein an end of said first piece is welded to an end of said second piece.

13. A firing tip according to claim 11, wherein said second piece is larger than said first piece, and said first piece includes a distal end sharpened to a point or said first piece is cut oblique.

14. A firing tip according to claim 13, wherein an outer surface of said first piece surrounds a center axis and presents an angle between 20 and 60 degrees relative to said center axis of said first piece, and said distal end of said first piece is sharpened to a point.

15. A firing top according to claim 11, wherein said first and second piece of said at least one rivet present a cylindrical shape.

16. A corona igniter, comprising:

a central electrode formed of an electrically conductive material and including a firing end, a firing tip disposed on said firing end of said central electrode, said firing tip including a base formed of metal and including a plurality of indentations, said firing tip including a plurality of rivets, each rivet disposed in one of said indentations of said base, each rivet formed of at least one precious metal and having a melting point and/or wear resistance greater than said base, said rivets are spaced from one another about a longitudinal axis of said firing tip, and said rivets project radially away from said longitudinal axis.

17. A corona igniter according to claim 16, wherein said central electrode extends from a terminal end to said firing end, an insulator formed of an electrically insulating material is disposed around said central electrode; and a shell formed of an electrically conductive metal material is disposed around said insulator.

18. A corona igniter according to claim 16, wherein said base includes extensions, each extension projects radially away from said longitudinal axis and includes one of said indentations containing one of said rivets.

19. A corona igniter according to claim 18, wherein said extensions and said rivets are disposed at the same angle relative to said longitudinal axis.

20. A corona igniter according to claim 16, wherein each rivet includes a first piece connected to a second piece, said first piece is formed of said at least one precious metal, said second piece is formed of nickel or a nickel alloy, and said base is formed of nickel or a nickel alloy.

21. A corona igniter according to claim 20, wherein said first piece is sharpened to a point.

22. A corona igniter according to claim 16, wherein said rivets are spaced equally from one another and located symmetrically around said longitudinal axis of said firing tip.

23. A corona igniter according to claim 16, wherein said base and said rivets are bent in the same direction and are disposed at the same angle relative to said longitudinal axis.

24. A corona igniter, comprising:

a central electrode formed of an electrically conductive material and including a firing end, a firing tip disposed on said firing end of said central electrode, said firing tip including a base formed of metal and including at least one indentation, said firing tip including at least one rivet, each rivet disposed in one of said indentations of said base, said at least one rivet formed of at least one precious metal and having a melting point and/or wear resistance greater than said base, wherein each of said at least one rivet includes a first piece connected to a second piece, said first piece is formed of said at least one precious metal, said second piece is formed of nickel or a nickel alloy, and said base is formed of nickel or a nickel alloy.

* * * * *